United States Patent [19]

Kehr et al.

[11] Patent Number: 4,768,177

[45] Date of Patent: Aug. 30, 1988

[54] METHOD OF AND APPARATUS FOR ALERTING A PATIENT TO TAKE MEDICATION

[76] Inventors: Bruce A. Kehr, 9429 Holbrood La., Potomac, Md. 20854; Albert L. Hedrich, 6804 Wemberly Way, McLean, Va. 22101

[21] Appl. No.: 88,262

[22] Filed: Aug. 24, 1987

Related U.S. Application Data

[63] Continuation-in-part of Ser. No. 628,420, Jul. 6, 1984.

[51] Int. Cl.[4] ..... G04B 47/00; B65D 83/04

[52] U.S. Cl. ..... 368/10; 221/2; 221/15; 340/309.4

[58] Field of Search ..... 368/10, 72–74; 221/2, 3, 9, 15; 340/309.15, 309.4; 364/415, 569

[56] References Cited

U.S. PATENT DOCUMENTS

| | | | |
|---|---|---|---|
| 4,223,801 | 9/1980 | Carlson | 368/10 |
| 4,258,354 | 3/1981 | Carmon et al. | 340/309.4 |
| 4,275,384 | 6/1981 | Hicks et al. | 340/309.4 |
| 4,293,845 | 10/1981 | Villa-Real | 340/309.1 |
| 4,361,408 | 1/1982 | Hirtschafter | 368/10 |
| 4,382,688 | 5/1983 | Machamer | 368/10 |
| 4,472,804 | 9/1984 | Behl | 221/3 |
| 4,483,620 | 11/1984 | Noble | 368/10 |
| 4,490,711 | 12/1984 | Johnson | 340/309.4 |
| 4,626,105 | 12/1986 | Miller | 368/10 |
| 4,682,299 | 7/1987 | McIntosh | 364/509 |
| 4,695,954 | 9/1987 | Rose et al. | 221/3 |

*Primary Examiner*—Vit W. Miska

*Attorney, Agent, or Firm*—Hall, Myers & Rose

[57] ABSTRACT

A device for indicating when medication should be taken has plural compartments, each of which may store medication. An electrical signaling system emits take-medication signals from time to time, each of which said signals indicates (a) that medication should be taken, (b) from which compartment the medication should be taken, (c) the quantity of medication to be taken from the designated compartment, and instructions for taking the medication. If a designated compartment is not promptly opened and closed, the electrical signaling system will sound an alarm. If each designated compartment is opened and closed, the take-medication signal and the alarm (if operating) are turned off. A reload signal is given once a week, as a reminder to reload the compartments with medication. The device has modular construction. A first module has: (a) one of the compartments, (b) an alarm for producing an audible signal to alert the patient to take medication, (c) a timing signal generator for producing timing signals, (d) a circuit for energizing the alarm in response to selected timing signals, and (e) a switch for turning off said alarm when the medication has been taken from the container in the first module. Each remaining module is a plug-in device which has a compartment, receives timing signals from the first module, sends signals to activate said alarm in response to selected timing signals and a manual switch for deactivating said alarm when medication is taken from the compartment in the module.

31 Claims, 3 Drawing Sheets

FIG.3
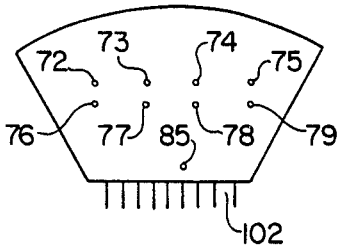
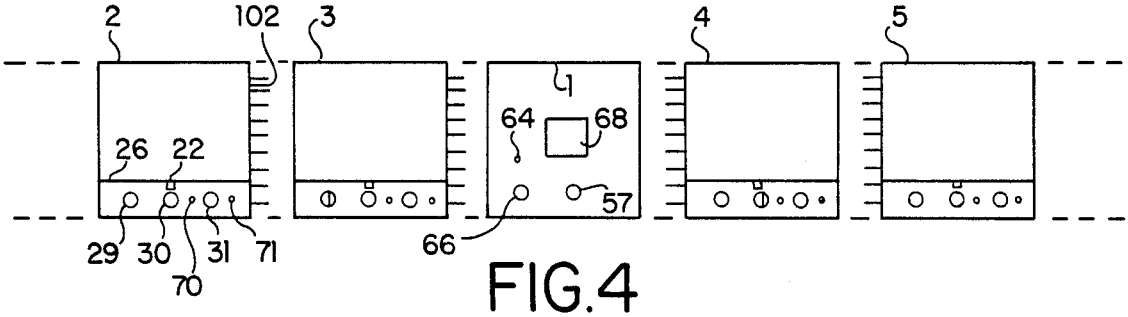
FIG.4
FIG.5
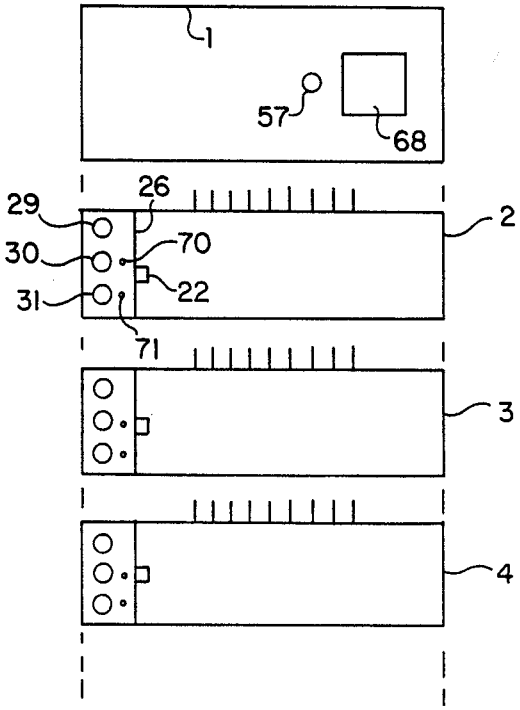
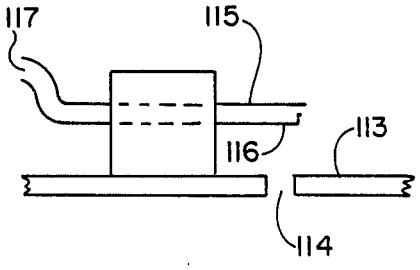
FIG.7

METHOD OF AND APPARATUS FOR ALERTING A PATIENT TO TAKE MEDICATION

RELATED APPLICATION

This application is a continuation-in-part of our prior copending application Ser. No. 628,420, pending filed July 6, 1984 entitled Apparatus for Alerting a Patient to Take Medication.

BACKGROUND OF THE INVENTION

Starting many years ago, patents were issued for inventions to dispense medication and/or to indicate the time of day at which medication should be taken. None of these patents, however, provides a reliable device that satisfies the need of persons, especially those who are infirm, who must take medications several times a day.

It is a frequent occurrence that a patient does not properly take his or her medication as prescribed by his or her physician. This is especially true for elderly patients who must take several different medications at various times throughout the day. The problem has been especially serious when the patient has impaired eyesight and/or is confused. The problem manifests itself in various ways, such as (1) failure to take the medication, (2) taking the wrong medication, (3) taking too much of, or too little of, the correct medication, and (4) taking the medication at an incorrect time.

Despite the fact that the aforesaid problem has existed for generations it remains unsolved. The closest approach has been a portable pill container that emits a signal when medication is to be taken. Such a device, while helpful, does not solve the problem. In particular, it does not store several medications in bulk, nor does it indicate to the patient which one of several prescribed medications is to be taken when the signal is given, much less does it signal how much of each medication is to be taken. It also fails to take action in the event that the patient does not heed the signal. It similarly lacks other useful features described in this application.

SUMMARY OF THE INVENTION

The longstanding problem described above has been solved by our invention described below:

Our device has a plurality of medication compartments which may be used to store a plurality of medications.

An electrical signaling circuit, having a timing system therein, not only gives an audible signal whenever medication is to be taken but also indicates the compartment (sometimes hereinafter referred to as a container) from which the medication is to be taken. This indication is given by illuminating a light bank positioned closely adjacent the desired compartment. The number of lights, illuminated in the light bank indicates the quantity of medication to be taken from the designatd compartment; i.e. if the medication is in the form of pills, the illumination of three lights, for example, of the bank, indicates that the three pills are to be taken from the designated compartment.

If the patient obeys the commands of the system and opens the designated compartment, removes the desired medication and then closes the compartment, the aforesaid signals and lights will be turned off until the next time arrives for taking medication.

If the patient fails to obey the commands of the system and does not open and close each designated compartment within a predetermined interval of time the audible signal stops, and a visual alarm will be given. This tells the patient that they forgot to access the appropriate compartment(s), which compartment(s) they forgot to access, and how much medication they forgot to take. The visual alarm and the lights will then be shut off when the designated compartment is opened and closed.

Generally, any single medication is to be taken periodically throughout the day. Therefore, the electrical circuitry associated with each compartment may be preset to any one of several periods, for example four, six, eight, twelve or twenty-four hours. The period for each compartment may be set independently of the settings for the other compartments, and the period for a given compartmet may be set independently of the settings for the other compartments, and the period for a given compartment may be selected so that it is appropriate to the specific medication in the compartment to which the setting is applicable. Likewise, each compartment has its own light bulb, which can be preset to moderate how much medication is to be taken from that specific compartment.

The device has a number of manually operable switches that are preset to obtain proper operating conditions. To avoid accidental manual operation of these switches they are mounted in a cavity in the casing, and can be depressed only with a pointed instrument. Each switch need only be pushed once to select an operation condition (e.g. push one switch to select a time interval, push one switch to select the number of lights to light up).

As stated above, the take-medication signal (including said light bank) and the alarm (if operating), are turned off when the patient opens and closes the compartment. This operation is carried out by having a separate closure (for example a lid) for opening and closing each compartment. When the lid is moved to close the compartment a switch, operating through the electrical circuit of the signaling system, turns off the take-medication signal (including said light bank), and the alarm (if it is operating).

A $\div 7$ divider receives the twenty-four hour signal and gives the reload signal, once a week, which directs the patient to reload the compartments with medication.

Each compartment has its own dedicated signaling circuits, although some parts such as a timing circuit, an audible signal, the visual alarm signal, and the reload signaling system, are common to all compartments.

The timing circuit feeds predetermined periodic timing signals to the signaling circuits of all compartments. There are settable switches associated with each compartment which enable the desired period (four hours, six hours, etc.) to be selected. Each signal of each group of periodic signals "sets" a bistable device which activates the take-medication bank of lights adjacent to the compartment containing the medication to be taken in response to such signal. An audible signal is also given. If in response to the command of the take-medication signal the patient opens and closes the lid of the applicable compartment, the bistable is "reset" and the take-medication signal is turned off. If the lid is not operated after a predetermined time, the bistable device remains "set" and a timing circuit turns on a visual alarm.

If desired, the audible signal may be a transducer which emits speech giving special instructions to the patient relating to the taking of the medication.

A separate compartment is provided for each medication. Each compartment is a separate module. A first such module has certain basic circuitry and the other modules each have a limited amount of dedicated circuitry which works in conjunction with the basic circuitry. The aforesaid first module may be used alone and will perform all the functions that a patient, who is taking only one medication one or more times a day, needs. If the patient takes two medications a day, he or she may add a second module for the second medication. The second module conveniently plugs into the first one and uses the basic circuitry of the first module. In like manner, additional similar modules may be added, as needed, to meet the patient's needs for the benefit of this invention in connection with additional medications. This assures that the patient receives separate information signals for each medication, telling him when to take each, which medication to take, how much to take, and whether he has remembered or forgotten to access the appropriate compartment by opening and closing the lid of the indicated compartment.

Prior art has not solved the problem of the patient on multiple medications, who needs a user-friendly device to give information about how to take each medication accurately. The present invention solves this problem, and in a cost effective way-the patient need only purchase as many modules as equals the number of different kinds of medication he takes.

BRIEF DESCRIPTION OF THE DRAWINGS

FIG. 3 is a bottom view of one of the Removable Modules showing the arrangement of the timing switches.

FIG. 4 is a top, exploded view of a Central Unit of rectangular cross section and four Removable Modules arranged with two on each side of the Central Unit.

FIG. 5 is a side, exploded view of a Central Unit of either reactangular or circular cross section and three Removable Modules arranged under the Central Unit and plugging into the bottom of the Central Unit.

FIG. 7 is a detail showing a possible arrangement of a switch located inside the central unit or one of the modules and that can be operated with a small diameter object that can be inserted through a hole but that cannot be operated accidently while carrying the pill box in a pocket or purse.

DETAILED DESCRIPTION

Figure 1:
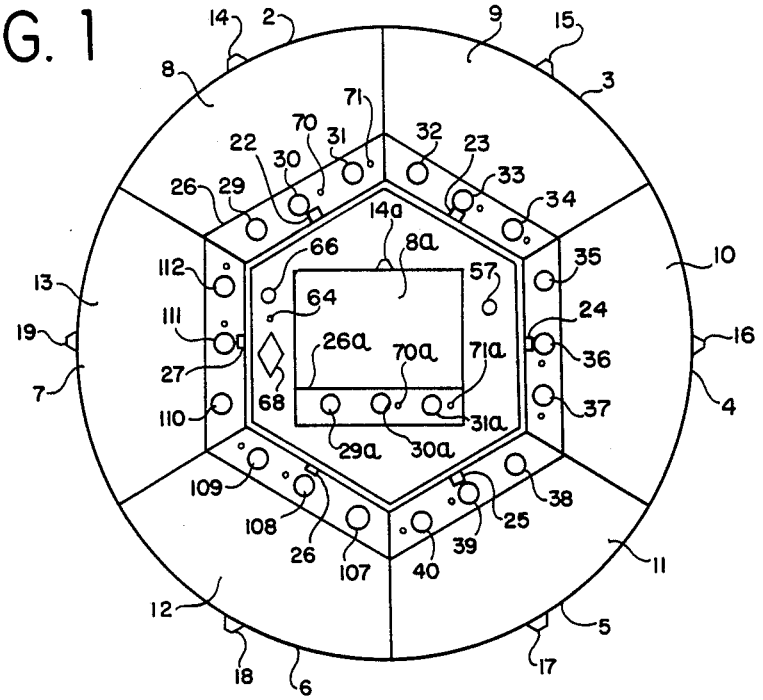
FIG. 1 is a top view of a modular pill box with a hexagonal Central Unit with six Removable Modules installed.
Figure 2:
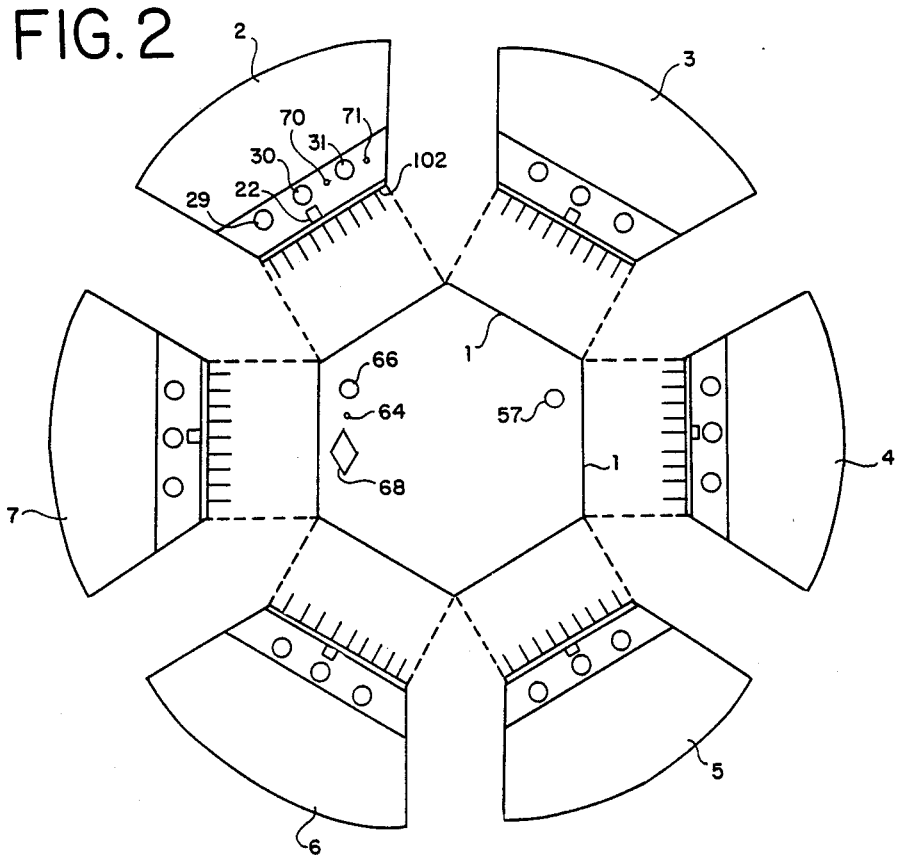
FIG. 2 is an exploded view of FIG. 1 showing the six Removable Modules separated from the Central Unit and showing the manner in which they plug into the Central Unit.

FIG. 1 illustrates a central unit 1 of hexagonal cross section having one built-in module and six different removable modules 2, 3, 4, 5, 6 and 7, containing pill compartments and having lids 8, 8*a*, 9, 10, 11, 12 and 13 respectively. Each of the six lids 8, 8*a*, 9, 10, 11, 12 and 13 for the seven pill compartments is pivoted at its inner end to the pill compartment; for example lid 8 is attached to the compartment in removable module 2 by a pivoted connection 26 which permits the lid 8 to be opened and closed by rotating it about the connection 26. Each of the lids 8, 8*a*, 9, 10, 11, 12 and 13 has means for holding it closed; for example, the lid 8 has a projection 14 which snaps over a contoured mating projection on the side of the pill compartment. The walls of the pill compartment are sufficiently flexible so that the lid can be opened with a reasonable force applied to the tab 14.

The lids 8, 8*a*, 9, 10, 11, 12 and 13 have associated electrical switches 22, 22a, 23, 24, 25, 26 and 27 respectively. Each of these seven switches is arranged to be momentarily closed (or opened if the associated circuitry so requires) when its complementary lid 8, 8*a*, 9, 10, 11, 12 or 13 is closed.

Figure 6:
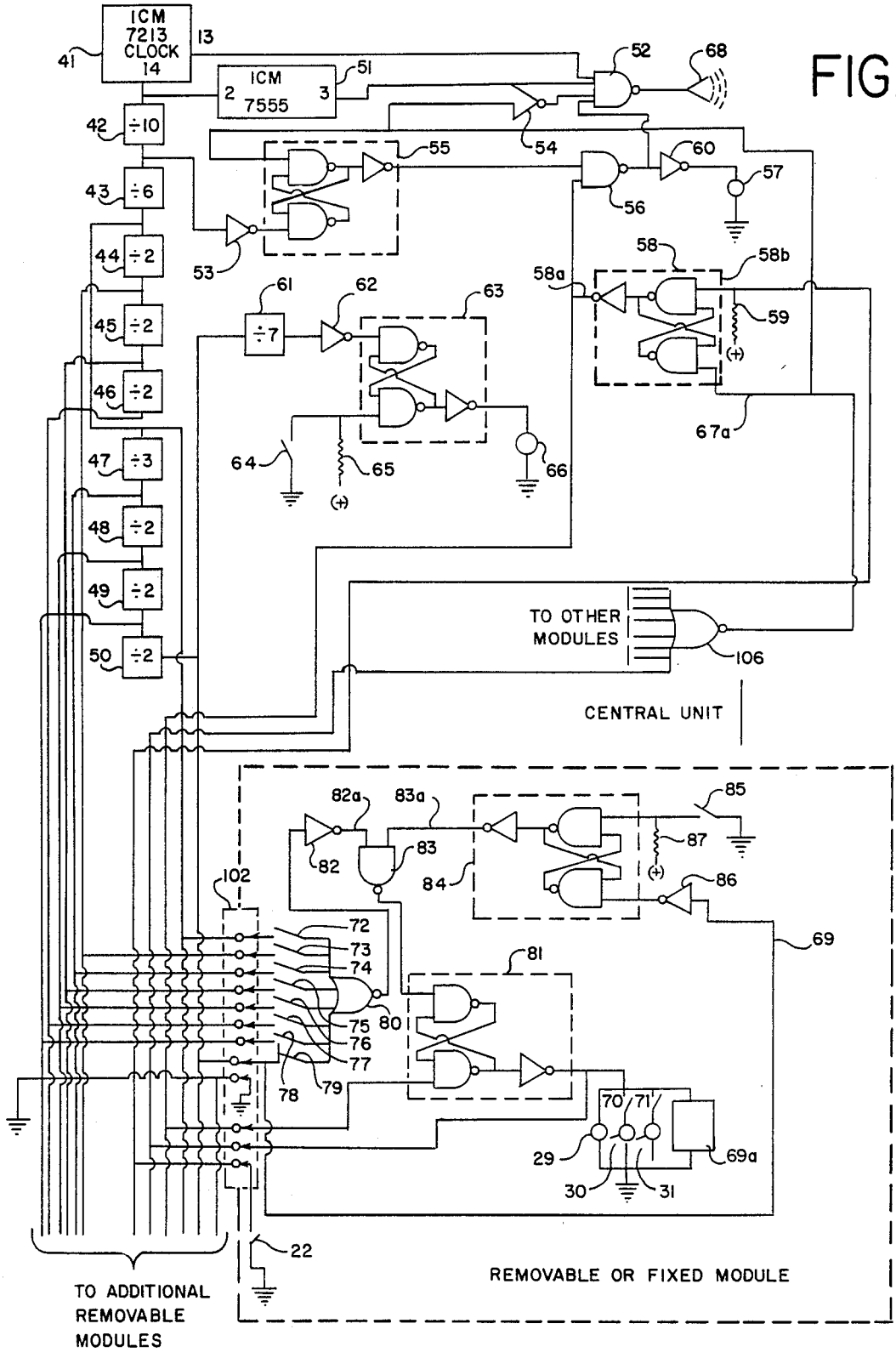
FIG. 6 is schematic diagram showing the electrical circuitry in both the Central Unit and one of the Removable Modules and the interconnection of the one Removable Module and the Central Unit.

Located within the central unit 1 is the electrical circuitry shown in that part of FIG. 6 labeled central unit and the circuitry for the built-in module. This circuitry supplies timing signals to the built-in module and using conductors that pass through connector 102 to each of the removable modules 2, 3, 4, 5, 6 and 7 that are to give signals from time to time to alert the patient to take one or more pills. Signals are also sent from the individual modules to the central unit. This circuitry also causes a red LED 57 to light if the patient fails to take the medication indicated from any one of the removable modules.

Located within the built-in module and each of the removable modules 2, 3, 4, 5, 6 and 7 is the electrical circuitry shown in that part of FIG. 6 labeled removable or fixed module. This circuitry uses the timing signals supplied by the central unit 1 to cause the alarm 68 located in the central unit 1 to sound at preselected intervals to alert the patient to take one or more pills. The circuitry indicates the number of pills to be taken by illuminating one or more of the three lights 29–31, 29*a*–31*a*, 32–34, 35–37, 38–40, 107–109 and 110–112 located on the built-in module and the removable modules 2–7 respectively. This circuitry also transmits the signals to the central unit necessary to control the audible alarm.

The central unit and the modules contain switches that perform various functions as described later. Some of the switches need only be arranged to make momentary contact to perform the desired function. Other switches must remain closed (or open if the circuit requires) to perform the desired function. It is important that the setting of the switches not be changed accidently when the pill box is carried in a pocket or purse. Therefore, the switches are contained with the containers comprising the central unit or module and can be accessed only through the use of a small diameter object (such as a bent paper clip or a pencil point). If the switch is one of those that must remain closed (or open) after being set, a latching mechanism is provided to cause it to remain in the desired state until it is reset.

Assume for purposes of illustration, that a patient is to take pills, everyday, as follows:

Pill A: 7 AM, 9 AM, 11 AM, 1 PM, 3 PM, 5 PM, 7 PM
Pill B: 7 AM, 10 AM, 1 PM, 4 PM, 7 PM
Pill C: 7 AM, 11 AM, 3 PM, 7 PM
Pill D: 7 AM, 1 PM, 7 PM
Pill E: 7 AM, 7 PM
Pill F: 7 AM only Pills A, B, C, D, E, and F would be placed in the compartments in modules 2, 3, 4, 5, 6 and 7 respectively.

The is repeated with modules 2, 3, 4, 5 and 6 and their associated lids 8–12 involved in a similar manner. Since no more pills are to be taken until 7 AM the next morning, switch 85 is momentarily closed thereby disabling the alarm until the next 24 hour signal is received at 7 AM the next morning at which time the sequence described above repeats itself.

The light bank 29–31 has three signal lights (FIG. 1) which are pre-settable, as will appear, so that when the light bank is energized only the correct number of these three lights will be energized. If one light is illuminated it means that the patient is to take only one pill from the compartment in module 2. When two of the lights are illuminated the patient is to take two pills from the compartment. When all three lights on a module are illuminated the patient is to take three pills.

Light bank 32–34 is located on module 3, light bank 35–37 is located on module 4, light bank 38–40 is located on module 5, light bank 107–109 is located on module 6 and light bank 110–112 is located on module 7. Thus each light bank serves one module with its associated pill compartment and its function in conjunction with its complementary module and pill compartment is the same as the function of light bank 29–31 in conjunction with module 2 and its pill compartment.

Since the timing circuitry repeats itself every 24 hours, each of the pill compartments associated with modules 2 to 7 may contain a number of pills; that is each pill compartment may contain a one-week supply of pills to be taken on the schedule set into the module containing that pill compartment.

The electronic circuitry shown in FIG. 6 shows the circuitry contained in the central unit and the connection through connector 102 to one removable module. Additional removable modules may be connected through additional connectors similar to connector 102 as shown. The diagrams shown in FIG. 6 show the logic and electronic circuitry to perform the following functions and operations:

The clock 41 with dividers 42 through 50 generate electrical signals at intervals of 1, 2, 3, 4, 6, 8, 12 and 24 hours (FIG. 6). The signal occurring at the desired interval is selected by closing the appropriate switch 72 through 79 (FIG. 6). When the selected signal occurs, the following events take place: Either one, two or three of the light emitting diodes (LED's), 29, 30 and 31, are energized depending on whether one or both of the switches, 70 and 71, are closed. These switches are set at the time the pill-box is initialized to indicate the number of units of medication to be taken. At the same time a liquid crystal display (LCD) **69*a* (FIG. 6) is caused to display a preset message such as "MEALS", "MORN" or "EVE". As explained in more detail later, there is one LCD 69*a* located on each module 2 through 7 so the patient will associate the message on an LCD 69*a* with the compartment complementary to that LCD. At the same time the audible alarm 68 (FIG. 6) produces a unique sound for a period of 15 seconds at the beginning of every minute for a period of ten minutes. If, during the ten minute period following initiation of the alarm, the lid 8 of module 2 (and the lid(s) of any other module(s) showing lights in the light bank energized) is opened and then closed the audible alarm, and the LED's and the LCD are shut off. If the alarm has not been answered by opening and closing the lid 8 within the ten minute period following initiation of the alarm, the audible alarm 68 is turned off. At the same time the red LED 57 is turned on. The red LED 57 will stay on as will the LED's and LCD until the lid 8 of the module is opened and closed. Opening and closing the lid 8 of the module 2 operates the switch 22 (FIGS. 1 and 6**) in a manner explained later.

If the invention is designed to have an LCD **69*a* with an output inscribed with the word "MEAL", the pill in the container associated with module 2 through 7 on which the word "MEAL" appears would be taken at the meal next following the illuminations of LCD 69*a*. Such a display would be installed at a visible and convenient location on each module designed for it. An LCD display and driver, suitable for part 69*a*** is described in the Intersil publication on pages 6-84 through 6-103, a copy of which is being filed with this application. Either ICM7233 which provides 4 characters of 18 segments or ICM7234 which will drive 5 characters of 18 segments, would be suitable.

A signal from the divider 61 occurs seven days later causing the yellow LED 66 to be turned on indicating that it is time to re-load the box with medication. Alternatively, an LCD display of "LOAD" could be used rather than the yellow LED 66. The "LOAD" signal recurs every seven days, and thereby instructs the patient to re-load the compartments associated with modules 2–7 with pills. After each reloading the patient momentarily depresses switch 64 to turn off the load signal light 66.

The following is a detailed description of the operation of the electrical circuit shown in FIG. 6. The symbols used in the figure follow accepted usage in showing logic devices. Where non-standard or special symbols are used, they are explained in the text.

The circuit in the upper part of the figure and labeled "Central Unit", contains all of that part of the circuit that is common to all of the removable modules that may be used. This common circuit includes the timing signals, the audible alarm signals, the alarm that indicates that one week has passed since electrical circuitry in each module, as we shall see, is settable to give signals at the various times, each day, at which pills are to be taken.

For Pill A, the patient will select circuitry in module 2 that will repeat its signals every two hours starting at 7 AM. For Pill B, the patient will select circuitry in module 3 that will repeat itself every three hours, again starting at 7 AM. For Pill C, the patient will select circuitry in module 4 that will repeat itself every four hours starting at 7 AM. For Pill D, the patient will select circuitry in module 5 that will repeat itself every six hours starting at 7 AM. For Pill E, the patient will select circuitry in module 6 that will repeat itself every twelve hours starting at 7 AM and for Pill F the patient will select circuitry in module 7 that repeats itself once each day at 7 AM.

To satisfy the above illustration, at 7 AM the circuitry of FIG. 6 will emit an audible signal for fifteen seconds, which audible signal will repeat itself once a minute for ten minutes until it is stopped by the operation of each of the switches 22–27 upon the closing of each of the lids 8–13 of modules 2–7 since pills from the compartments in each of the modules is to be taken at 7 AM. At 9 AM the circuitry of FIG. 6 will emit an audible signal for fifteen seconds, which audible signal will repeat itself once a minute for ten minutes until it is stopped by the operation of switch 22 upon the closing of the lid 8 of module 2 since a dosage of pills in the compartment in module 2 is to be taken at 9 AM. At 10 AM the circuitry of FIG. 6 will emit an audible signal as described above until it is stopped by the operation of switch 23 upon the closing of the lid 9 of module 3 since a dosage of pills in the compartment in module 3 is to be taken at 10 AM. At 11 AM the audible signal will be emitted again as described above and will repeat itself for ten minutes until it is stopped by the operation of switches 22 and 24 upon the closing of the lids 8 and 10 of modules 2 and 4 since dosages of pills in the compartments in modules 2 and 4 are to be taken at 11 AM. At 1 PM the same sequence of events as described above will occur except that the audible signal will be stopped by the closing of the lids 8, 9 and 11 on Modules 2, 3 and 5 since dosages of pills in compartments in these modules are to be taken at 1 PM. At 3 PM the same sequence of events occurs with the involvement of modules 2 and 4 with the closing of lids 8 and 10 on these modules since dosages of pills from these compartments are to be taken at 3 PM. At 4 PM the same sequence of events occurs with only module 3 and its lid 9 involved as described above. Similarly, at 5 PM the same sequence occurs with only module 2 and its associated lid 8 involved. At 7 PM the sequence the supply of medication in the individual modules has been replenished and the alarm indicating that the patient failed to take the medication.

The circuitry that determines the interval between alarm signals; that causes one, two or three lights to be turned on to indicate the number of pills to be taken; that allows the individual module to be disabled overnight and that activates LCD 69*a* is all shown in the lower part of the figure and is labeled "Removable Module".

Each individual module is connected to the central unit through a connector 102 that will accommodate all wires necessary to convey all timing signals, control voltages and power supply voltages required by the circuitry for it to perform the required functions. Different modules may be equipped for only certain functions and will, therefore, not utilize all of the connections that may be provided. The circuits providing the power for the operation of the circuitry is not shown but is well known by anyone skilled in the art. Additional connections would be provided on the connector 102 to conduct the necessary supply voltages to the components contained in the removable module for its proper operation.

All timing signals and the electrical signals for the audible signal originate in the clock 41. A commercially available unit suitable for this function is the Instersil ICM7213 One Second/One Minute Precision Clock and Reference Generator. This is described in detail on pages 7-42 through 7-46 of the Intersil reference book, HOT IDEAS IN CMOS. Photocopies of the referenced pages are being filed with this application. The signal present on pin 14 of this clock 41 is an electrical pulse occurring at a rate of one pulse per minute (1/60 Hz). These pulses are applied to a string of dividers 42 through 50 that act to divide the frequency at which the pulses occur. This is equivalent to multiplying the time interval between pulses by the same factor. The divide-by-ten (÷10) divider 42 is typically a Motorola MC14017B Decade Counter/Divider as shown on page 7-54ff of Motorola publication DL-105. The ÷6 divider 43 and ÷3 divider 47 are typically Motorola MC14018B Presettable Divide-by-N Counters described on page 7-59ff of the same Motorola publication. The ÷2 dividers 44, 45, 46, 48, 49 and 50 are typically Motorola MC14516B Binary Up/Down Counters described on page 7-406 of the same Motorola publication. Copies of the applicable pages of said Motorola publication are being filed with this application.

The ÷10 divider 42, and ÷6 divider 43, taken together divide the output of the clock 41 by 60 and therefore produce a pulse once per hour at the output of divider 43. Dividers 44, 45 and 46 generate pulses at intervals of 2, 4 and 8 hours respectively. In a similar fashion, dividers 47 through 50 generate pulses at intervals of 3, 6, 12 and 24 hours.

The eight lines from the dividers and terminating at the connector 102 carry the signals for the eight periods described above. Although not shown in the figure, additional connectors can be provided for as many modules as may be required. In applications where more than one module is provided for, the eight lines carrying the signals for the eight periods described above, also terminate in a number of connectors similar to connector 102 equal to the maximum number of modules to be accommodated. Refer now to FIG. 6. A typical removable module is shown in the figure. Each module has a set of parts identical to those shown. It should be understood that the description of the electrical circuitry for one module is valid for any other module. All timing signals go to all modules independently of what is happening with any of the others. Whether or not the alarm 68 is answered for one compartment has no bearing on whether the alarm 68 will sound for one of the other modules.

The following description applies to the operation of one removable module. If more than one such module is used, the same description applies to all such modules.

The timing cycle for each module is set independently for each module. To select the desired timing, one of the switches 72 to 79 is closed. For example, if it is desired to select a four hour period between the taking of pills, switch 75 would be closed. The timing for each module is set separately and is independent of the timing chosen for any of the other modules. At the chosen time the signal through switch 75 is applied to one of the inputs of the eight-input NOR Gate described on page 7-5ff of the above-referenced publication. A copy of this publication is being filed with this application. All inputs and outputs of logic elements referred to in the remainder of this description can have only two states, 0 and 1, unless the contrary is explicitly stated.

A NOR gate has the property that the output is 1 as long as all inputs are 0. If any input is 1, the output goes to 0. Therefore, the output of the NOR gate 80 is 1 until an alarm signal drives one of the eight inputs to 1 at which time the output goes to 0.

The latch 81 shown in dotted lines is typically a Motorola MC 14044B Quad NAND R-S Latch described on page 7-120ff of the above-referenced Motorola publication. A copy of this publication is being filed with this applications. The designation "Quad" indicates that there are four such latches in a single integrated circuit package. There are two such latches in each of the modules. One such module is shown in FIG. 6. Typically the two latches 81 and 84 in each module would be two of the latches included in such an integrated circuit package. The remaining two would not be used. A NAND R-S latch has the property that a momentary transition from 1 to 0 on one of the inputs produces an output level that remains at this level until an appropriate level change at one of the inputs causes it to change to the other level, hence the name latch. The change can be momentary and the condition is latched-in until changed.

The top input to latch 81 may be driven from the output of NOR gate 80 and NAND gate 83. The output of the NOR gate 80 goes to 0 level when a timing signal is applied to one of its inputs. Its output is applied to the input of NAND gate 83 through inverter 82. This inverter is typically Motorola MC14049UBV Hex Inverter/Buffers described on page 7-129ff of the above-referenced Motorola publication. An inverter has the property that it changes the input to its complement at the output. Thus, if the input is at a 1 level, the output is at a 0 level and vice-versa. The Hex designation indicates that there are six inverters on a single IC. When the output of NOR gate 80 goes to level 0, the signal on line 82*a* will go to a 1 level due to the action of the inverter 82. The other input to the NAND gate 83 is held at a 1 level by the output of latch 84 as will be explained later. With the two inputs to the NAND gate 83 at a 1 level, the output of the NAND gate 83 will go to a 0 level.

When the top input to latch 81 is driven (as just explained) to a 0 level by the output of the NOR gate 80 and NAND gate 83, the output shown on the right side of the dotted rectangle is driven from 0 to 1. The output stays at this level until driven to 0 by the appropriate signal to the other input as will be described later. An output level of 1 usually represents a voltage level of about 4.5 to 5.0 volts. This is an appropriate voltage to turn on one or more of the green LED's 29, 30 and 31. LED 29 will always come on when alarmed and LED's 30 and 31 will come on when alarmed if switches 70 and 71, respectively, are closed.

The signal energizing the LED's 29, 30 and 31 is applied via connector 102, and the eight input NOR gate 106 to three logic elements located in the part of the circuit common to all of the removable modules and located in the central unit of the box as shown in FIG. 6: the inverter 54, the R-S latch 55 and the R-S latch 58. The function of each of these elements will be described below. The NAND gate 52 is typically a Motorola MC14012B Dual 4-input NAND Gate described on page 7-5ff of the above-referenced Motorola publication. The designation "Dual" indicates that there are two identical gates on a single IC. A NAND gate has the property that the output is at a 1 level if any one of the inputs is at a 0 level. When all the inputs are at a 1 level, the output goes to a 0 level. NAND gate 52 is used to turn on the audible alarm 68 when its output goes to 0.

As long as the level at the output of the NOR gate 106 is at 1, the output of the inverter 54 will be 0 and the other three inputs to the NAND gate 52 will have no effect on the output. However, when the level at the output of the NOR gate 106 goes to a level of 0, the level at the output of the inverter goes to 1, and control goes to the other inputs of gate 52. The output of the NOR gate 106 is at a level of 0 whenever any of its eight inputs are at a level of 1. The inputs to the NOR gate 106 are derived from the outputs of latch 81 in the various removable modules installed. Therefore, if any of the LED's in any of the installed modules are on indicating that medication from that module should be taken, the output of the NOR gate 106 is at 0. Timer 51 controls one of the other inputs to NAND gate 52. Therefore, if two or more modules are set to sound an alarm at the same time, all would have to be reset before the output of NOR gate 106 would go to a level of 1.

Timer 51 typically is an Intersil ICM7555 and is described on page 6-155ff of the Intersil publication referred to above. In this application it is used as a monostable pulse generator as shown in FIG. 4, page 6-158 of the Intersil publication. The trigger applied to pin 2 of the timer 51 is obtained from the clock 41 output consisting of a pulse once per minute. The resistor and capacitor shown in FIG. 4 of the Intersil data book are chosen to produce a pulse of approximately 15 seconds width. The positive output pulse from pin 3 of the timer 51 is applied to one of the inputs of gate 52, hereinafter referred to as the center input. Thus, for the first 15 seconds of each minute the center input of gate 52 is at a 1 level. Thus, when the output of the NOR gate 106 is at 0 level, control of the output of gate 52 is transferred to the top input for the first 15 seconds of each minute.

The top input to gate 52 is obtained from pin 13 of the clock 41. This signal consists of a composite of a 1024 Hz, a 16 Hz and a 2 Hz signal. When converted into sound waves by the transducer 68, it produces a very distinctive alarm sound. When the other three inputs to gate 52 are at a 1 level, this signal from the clock 41 controls the output of gate 52 which is applied to the audible sound generator or transducer 68. Thus the signal will sound for the first 15 seconds of each minute as long as the signal at the output of the NOR gate 106 is at a 0 level.

Instead of applying the electrical alarm signal generated by the clock 41 to the audible signal generator 68, the electrical signal at the output of NAND gate 52 could be applied to the input of a hearing aid earphone so that the signal would be audible to a person with a hearing impairment. Alternatively, the output of NAND gate 52 may actuate a voice synthesizer, or the loud speaker of a radio or television set. A suitable voice synthesizer is shown and described on pages 28 to 42 of the March 1984 issue of BYTE magazine. A copy of this article is being filed with this application. The output of the voice synthesizer would feed the earphone of a hearing aid or a loudspeaker with instructions for taking the medication. Alternatively, the signal fed to audible signal generator 68 could start a recorder which would emit audible voice instructions to the patient as to how to take the medication.

The signal at the output of NOR gate 106 is also applied to the inputs of the two latches 55 and 58. Therefore, as a result of the alarm signal, the top input to latch 55 is driven from a 1 level to a 0 level. The output of the latch 55 is driven to a 0 level which is applied to the top input of NAND gate 56 insuring that its output is at a 1 level. The inverter 60 output is at a 0 level and the red LED 57 is off. At the same time, the lower input 67*a* of latch 58 is driven to a 0 level by the signal from NOR gate 106 applied to this input. This drives the output of latch 58 to a 1 level which is applied to the bottom input of NAND gate 56. This transfers control of gate 56 to the top input. If the alarm is not answered by opening and closing the lid of the applicable module, during the ten minute period following the initiation of the alarm, a signal from the ÷10 divider 42 will drive the bottom input of latch 55 to a 0 level through inverter 53 which will cause the output of latch 55 to go to a 1 level. The output of NAND gate 56 will go to a 0 level and the red LED 57 will be turned on through inverter 60 and the sound emitted by transducer 68 will be turned off.

If, however, the alarm is answered by opening and closing the lid 18 of the compartment in the removable module, the switch 22 is closed, momentarily, driving the top input 58*b* of latch 58 to a 0 level. The output 58*a* of latch 58 and the input of gate 56 will be driven to a 0 level and the red LED 57 will not be turned on. If the lid 18 of the compartment 14 is opened and closed after the 10 minutes following the alarm, the red LED 57 will be turned off.

The signal on the output 58*a* of latch 58 also is applied to the bottom input of latch 81 in the removable module through connector 102. The bottom input to latch 81 will go to a 0 level when the lid 18 of the compartment 14 is closed. This will drive the output of latch 81 to a 0 level and the green LED's 29, 30, and 31 will be turned off. At the same time the input to NOR gate 106 will go to a 0 level, its output will go to a 1 level if no other removable modules are alarmed, turning off the audible alarm 68. The entire system will be returned to a condition of readiness to accept the next alarm signal and the entire process will repeat as described above.

Each removable module is equipped with a circuit to allow the user of the pill box to disable the alarm on that particular module. Any such module so disabled will be automatically restored to its normal operating condition at the next occurrence of the 24-hour alarm signal at 7 AM. The reason for this is that it is probable that under some circumstances the patient would not want the alarm to sound during the night. However, in the event the patient failed to restore the system to its normal operating condition the next morning it is desired that this would be accomplished with components 82 through 87 (FIG. 6) in each removable module.

The night shut-off circuit operates in the following manner. Under normal conditions, i.e. the alarm is set and not disabled, the right hand input 83*a* to NAND gate 83 is held positive by the output of the latch 84. It is assumed that a 24-hour signal on line 69 has occurred after the circuits for all removable modules of the system were disabled. The disabling signal would have driven the bottom input to latch 84 from a 1 to a 0 state. Under this condition any signal applied to the input of NOR gate 80 through one of the switches 72 through 79 will cause the input of NAND gate 83 to go to a 1 state, driving the top input of latch 81 to 0. The sequence of events described above will then occur.

If and when it is desired to disable the circuit from a given removable module, "night" switch 85 is closed momentarily, causing the output 83*a* of latch 84 to go to 0. Under this condition the output of the NAND gate 83 will be 1 and will be unaffected by any input on its left hand input 82*a*. This condition will persist until the occurrence of the 24-hour alarm signal on line 69 (see FIG. 6). The 24-hour signal on line 69 resets latch 84 for normal daytime operation. Resistor 87 insures that the top input to latch 84 is at 1 until switch 85 is closed. A separate switch 85 is included in each of the removable modules. It is necessary to disable each module for night shut-off individually. This provides for some medication to be taken during the night, if necessary, with the alarm for other removable modules to be disabled.

When the box is initially set it is only necessary to insure that the 24-hour signal occurs at the desired time in the morning; in this illustration at 7 AM. In the preferred form of FIG. 6, the components included within the dotted lines defining the "Removable Module", are included for the example removable module used in the above explanation. A "duplicate set" of all of these parts is used for each of the other removable modules.

The use of an eight-input NOR gate 106 provides for a maximum of eight removable modules. If more than eight such modules are desired, provision can be made for them by use of circuitry well known to those skilled in the art. It is unlikely, however, that more than eight would be used on a single pill box.

The top input to gate 52 is obtained from pin 13 of the clock 41. This signal consists of a composite of a 1024 Hz, a 16 Hz and a 2 Hz signal. When converted into sound waves by the transducer 68, it produces a very distinctive alarm sound. When the other three inputs to gate 52 are at a 1 level, this signal from the clock 41 controls the output of gate 52 which is applied to the audible sound generator or transducer 68. Thus, the signal will sound for the first 15 seconds of each minute for ten minutes as long as the signal on the C line is at a 1 level.

The medication need not be in the form of pills, for example, a small bottle of eye drops may be placed in one the compartments.

The latches referred to above are a species of bistable devices.

The apparatus shown in the drawings is portable and may be carried in a pocketbook. The electrical apparatus may be supplied with power from a small battery (not shown). A conventional device for emitting signals when the battery needs replacing may be employed if desired.

Since the timing circuitry repeats itself every 24 hours, each of (modules) 2 to 7 may contain a number of pills; that is (module) 2 may contain a one-week supply of pill A, (module) 3 may contain a one-week supply of pill B, etc. At the same time that one or more lights of bank 29, 30 and 31 are energized, the liquid crystal display (LCD) 69*a* is caused to display a preset message such as "MEALS", "MORN" or "EVE". As explained in more detail later, there is one LCD 69*a* for each module, and each such LCD 69*a* is closely adjacent its complementary module so that the patient will associate the message on an LCD 69*a* with the module complementary to that LCD.

Each light bank such as 29, 30, and 31 is so located on its complementary module that when any light of the bank is energized, it indicates to the user of the device the particular module from which medication is to be taken. For example, in FIG. 1, light bank 29, 30 and 31 is immediately adjacent lid 8, so that if any light of bank 29, 30 and 31 is energized the user will have no doubt that medication from module 2 should be taken. The number of lights lit tells how much medication is to be taken (e.g. if lights 29 and 30 are lit, then two pills are to be taken from the complementary module 2).

We claim to have invented:

1. In a device for providing medication:

a first unit for providing medication including a container for medication, a timing circuit for producing timing signals, and signaling means for giving a signal capable of human detection to indicate that medication should be taken, said signaling means giving said signal that is capable of human detection in response to a start signal; said first unit including control means, controlled by at least some of said timing signals, for producing a start signal which energizes said signaling means and thereby indicates that medication should be taken, said first unit also including manually operable means for deactivating said signaling means, and a second unit removably associated with said first unit and having a medication container independent of the container of the first unit; said second unit including (a) means for receiving timing signals from said timing circuit of said first unit, (b) means responsive to at least one of the received timing signals for sending a start signal to said signaling means to produce a signal capable of human detection, and (c) manually operable means for sending another signal to said first unit for deactivating said signaling means.

2. In a device for providing medication as defined in claim 1:

said first unit having a socket, and said second unit being a plug-in device that plugs into said socket and which sends its signals to said first unit through said socket.

3. In a device for providing medication as defined in claim 1:

a third unit removably associated with at least one of the first and second units and having a medication container independent of the containers of the first and second units, said third unit including (a) means for receiving timing signals from said timing circuit of the first unit and (b) means for sending a start signal to said first unit to start said signaling means and (c) means for sending another signal to said first unit for deactivating said signaling means.

4. In a device for providing medication as defined in claim 1:

said device including first indicating means for indicating that the medication should be taken from said first unit when said control means energizes said signaling means, and said device also including second indicating means for indicating that medication should be taken from said second unit when said start signal is sent to said first unit.

5. In a device for providing medication as defined in claim 4 in which said first indicating means is mounted on said first unit and said second indicating means is mounted on said second unit.

6. In a device for providing medication as defined in claim 1, in which said first unit is a central module having a periphery, and a plurality of sockets around said periphery, a plurality of plug-in modules that respectively plug into said sockets, said plug-in modules including said second unit, each of said plug-in modules having: manual operable means, a container for medication, and means responsive to at least some of said timing signals and to said manually operable means for controlling said signaling means.

7. In a device for providing medication as defined in claim 1:

said container of said first unit having a first-movable lid, said first-named means for deactivating said signaling means being controlled by movements of said first lid, said container of said second unit having a second movable lid, said means of the second unit for deactivating said signaling means being controlled by movements of said second lid.

8. In a device for providing medication as defined in claim 1:

means operated by said control means for indicating the amount of medication that should be taken from said first unit, and means responsive to said last-named start signal for indicating the amount of medication to be taken from said second unit.

9. In a device for providing medication as defined in claim 1:

said first-named manually operable means including a manually operable closure for said first-named container, said first-named manually operable means deactivating said signaling means when said manually operated closure is moved in a predetermined manner, said manually operable means of said second unit including a manually operable closure for the container of said second unit, said manually operable means deactivating said signaling means when said manually operable closure for the container of the second unit is moved in a predetermined manner.

10. In a device for providing medication as defined in claim 1:

means which is part of said first unit for giving a signal capable of human detection, which is different from said first-named signal capable of human detection, in event said second-named means of said second unit sends a start signal to said signaling unit which is not followed within a predetermined time by said another signal.

11. In a device for providing medication as defined in claim 1:

means for suspending operation of said signaling means.

12. In a device for providing medication as defined in claim 1:

means for suspending operation of said signaling means until a predetermined time.

13. In a device for providing medication as defined in claim 1:

said timing circuit producing a plurality of groups of timing signals, at least one timing signal of one group occurring at a different time than any of the timing signals of another group, said means of said second unit for receiving timing signals, receiving said plurality of groups, and said second unit including means for selecting one of said plurality of groups, the second-named means of said second unit producing a start signal in response to at least one of timing signal of the selected group.

14. In a device for providing medication:

a first unit for providing medication including a container for medication, a timing circuit for producing timing signals, and signaling means for giving a signal capable of human detection to indicate that medication should be taken, said signaling means giving said signal that is capable of human detection in response to a start signal; said first unit including control means, controlled by at least one of said timing signals, for producing a start signal which energizes said signaling means and thereby indicates that medication should be taken, said first unit also including manually operable means for deactivating said signaling means, and a second unit removably associated with said first unit and having a medication container independent of the container of the first unit; said second unit including:

(a) means responsive to at least one of said timing signals for sending a start signal to said signaling means to produce a signal capable of human detection, and (b) manually operable means for deactivating said signaling means.

15. In a device for providing medication as defined in claim 14:

said first unit having a socket, and said second unit being a plug-in device that plugs into said socket and which exchanges signals with said first unit through said socket.

16. In a device for providing medication as defined in claim 14:

a third unit removably associated with at least one of the first and second units and having a medication container independent of the containers of the first and second units, said third unit including (a) means responsive to at least one of said timing signals for sending a start signal to said first unit to start said signaling means and (b) means for deactivating said signaling means.

17. In a device for providing medication as defined in claim 14:

said device including first indicating means for indicating that the medication should be taken from said first unit when said control means energizes said signaling means, and said device also including second indicating means for indicating that medication should be taken from said second unit when said start signal is sent from said second unit to said first unit.

18. In a device for providing medication as defined in claim 17 in which said first indicating means is mounted on said first unit and said second indicating means is mounted on said second unit.

19. In a device for providing medication as defined in claim 14, in which said first unit is a central module having a periphery, and a plurality of sockets around said periphery, a plurality of plug-in modules that respectively plug into said sockets, one of said plug-in modules comprising said second unit; each of said plug-in modules having: manual operable means, a container for medication, and means responsive to at least one of said timing signals and to said manually operable means for controlling said signaling means.

20. In a device for providing medication as defined in claim 14:

said container of said first unit having a first-movable lid, said first-named means for deactivating said signaling means being controlled by movements of said first lid, said container of said second unit having a second movable lid, said means of the second unit for deactivating said signaling means being controlled by movements of said second lid.

21. In a device for providing medication as defined in claim 14:

first indicating means operated by said control means for indicating the amount of medication that should be taken from said first unit, and second indicating means for indicating the amount of medication to be taken from said second unit, said first indicating means being mounted on said first unit so that its indications will show the amount of medication to be taken from said first unit, said second indicating means being mounted on said second unit so that its indications will show the amount of medication to be taken from said second unit.

22. In a device for providing medication as defined in claim 14:

said first-named manually operable means including a manually operable closure for said first-named container, said first-named manually operable means deactivating said signaling means when said manually operated closure is moved in a predetermined manner, said manually operable means of said second unit including a manually operable closure for the container of said second unit, said manually operable means deactivating said signaling means when said manually operable closure for the container of the second unit is moved in a predetermined manner.

23. In a device for providing medication as defined in claim 14:

means which is part of said first unit for giving a signal capable of human detection, which is different from said first-named signal capable of human detection, in event said last-named means of said second unit does not deactivate said signaling means within a predetermined time after said second unit sends a start signal to said first unit.

24. In a device for providing medication as defined in claim 14:

means for suspending operation of said signaling means.

25. In a device for providing medication as defined in claim 14:

means for suspending operation of said signaling means until a predetermined time.

26. In a device for providing medication as defined in claim 14:

said timing circuit producing a plurality of groups of timing signals, at least one timing signal of one group occurring at a different time than any of the timing signals of another group, said second unit receiving said plurality of groups of timing signals, and said second unit including means for selecting one of said plurality of groups, said second unit including means for producing a start signal in response to at least one of timing signals of the selected group.

27. In a device for providing medication as defined in claim 14:

said first-named manually operable means including means so that the first-named manually operable means can only deactivate said signaling means when the signaling means was activated by a start signal that originated from said first unit.

28. In a device for providing medication as defined in claim 14:

said last-named manually operable means including means so that the last-named manually operable means can only deactivate said signaling means when the signaling means was activated by a start signal that originated from said second unit.

29. In a device for providing medication as defined in claim 14:

said first-named manually operable means including means so that the first-named manually operable means can only deactivate said signaling means when the signaling means was activated by a start signal from said first unit, said last-named manually operable means including means so that the last-named manually operable means can only deactivate said signaling means when the signaling means was activated by a start signal that originated from said second unit, said first and second units comprising means so that if there were start signals from both units, and said signaling means has been rendered active by reason of at least one of said start signals, that said signaling means can be deactivated only by operation of both of said manually operable means.

30. In a device for providing medication as defined in claim 1:

said first-named manually operable means including means so that the first-named manually operable means can only deactivate said signaling means when the signaling means is activated by a start signal that originated from said first unit.

31. In a device for providing medication as defined in claim 1:

said last- named manually operable means including means so that the last- named manually operable means can only deactivate said signaling means when the signaling means is activated by a start signal that originated from said second unit.

* * * * *

UNITED STATES PATENT AND TRADEMARK OFFICE

CERTIFICATE OF CORRECTION

PATENT NO. : 4,768,177

DATED : August 30, 1988

INVENTOR(S) : Bruce A. KEHR, Albert L. HEDRICH

It is certified that error appears in the above-identified patent and that said Letters Patent is hereby corrected as shown below:

Under heading 76 on the cover page of the patent, correct the spelling of "Holbrook";

Column 1, line 57, correct the spelling of "designated";

Column 2, lines 16 to 18, delete: "and the period for a given compartment may be set independently of the settings for the other compartments";

line 22, change "bulb" to --bank--;

line 23, change "moderate" to --indicate--;

Column 3, line 67, change "six" to --seven--;

Column 4, line 3, change "26" to --22--.

The text starting with the word "electrical" in Column 6, line 38 and ending with the word "sequence" in line 22, Column 7, should be deleted from its present location and interposed after the word "The" in line 1, column 5. Accordingly, the material starting with "the supply" in line 22, Column 7, follows the word "since" in Column 6, line 38.

UNITED STATES PATENT AND TRADEMARK OFFICE

CERTIFICATE OF CORRECTION

PATENT NO. : 4,768,177

DATED : August 30, 1988

INVENTOR(S) : Bruce A. KEHR, Albert L. HEDRICH

It is certified that error appears in the above-identified patent and that said Letters Patent is hereby corrected as shown below:

Column 10, line 68, change "18" to -- 8 --.

Signed and Sealed this

Fourteenth Day of March, 1989

*Attest:*

DONALD J. QUIGG

*Attesting Officer*

*Commissioner of Patents and Trademarks*